US007803011B1

(12) United States Patent
Mai

(10) Patent No.: US 7,803,011 B1
(45) Date of Patent: Sep. 28, 2010

(54) BATTERY CONNECTOR

(75) Inventor: Yuan-Li Mai, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/585,991

(22) Filed: Sep. 30, 2009

(51) Int. Cl.
*H01R 3/00* (2006.01)

(52) U.S. Cl. ..... 439/500; 439/862

(58) Field of Classification Search ..... 439/862, 439/733.1, 500, 746
See application file for complete search history.

(56) References Cited

U.S. PATENT DOCUMENTS 5,259,769 A * 11/1993 Cruise et al. ..... 439/65
6,022,248 A * 2/2000 Wu et al. ..... 439/862
6,951,488 B2 * 10/2005 Hsieh ..... 439/660
7,390,229 B2 * 6/2008 Huang et al. ..... 439/862

* cited by examiner

*Primary Examiner*—Tho D Ta
(74) *Attorney, Agent, or Firm*—Rosenberg, Klein & Lee

(57) ABSTRACT

A battery connector includes an insulating housing defining a plurality of terminal receiving cavities and a plurality of conductive terminals. An upper portion of a side of the terminal receiving cavity protrudes to form a positioning portion which extends downward to form a buckling portion with a positioning groove formed therebetween. Each of the conductive terminals includes a base portion, a contact portion and an elastic portion elastically connecting the contact portion to the base portion. A free end of the contact portion is bent towards the elastic portion to form a propping portion. The base portion and the elastic portion are located in the terminal receiving cavity. The contact portion projects out of the top surface. The propping portion is positioned in the positioning groove and restrained by the positioning portion and the buckling portion to buffer an external lateral force affecting on the conductive terminal.

10 Claims, 7 Drawing Sheets

BATTERY CONNECTOR

BACKGROUND OF THE INVENTION

1. Field of the Invention

The present invention generally relates to an electrical connector, and more particularly to a battery connector.

2. The Related Art

A conventional battery connector used in a mobile phone or other portable electronic devices includes an insulating housing defining a plurality of terminal receiving cavities therein, and a plurality of conductive terminals disposed in the corresponding terminal receiving cavities. Each of the conductive terminals has a base board, an elastic portion crookedly extending upward from an edge of the base board, and a contact portion extending upward from a free end of the elastic portion to stretch out of the insulating housing for contacting a corresponding battery.

However, an external lateral force may affect on the contact portion of the conductive terminal to make the conductive terminal deformed because the contact portion is exposed out of the insulating housing without any restraining structures. The conventional battery connector is so designed that can only bear a relative weak external lateral force on the conductive terminal. Therefore, an improved battery connector capable of overcoming the foregoing problems is desired.

SUMMARY OF THE INVENTION

An object of the present invention is to provide a battery connector. The battery connector includes an insulating housing and a plurality of conductive terminals disposed in the insulating housing. The insulating housing defines a plurality of terminal receiving cavities each extending vertically and longitudinally to pass through a front surface and a top surface thereof. An upper portion of a side of each of the terminal receiving cavities protrudes towards an opposite side of the terminal receiving cavity to form a positioning portion. One end of the positioning portion extends downward to form a buckling portion with an originated end extending under the positioning portion. A positioning groove is formed between the positioning portion and the buckling portion. Each of the conductive terminals includes a base portion, a substantially inverted-V shaped contact portion and an elastic portion elastically connecting the contact portion to the base portion. A free end of the contact portion is bent towards the elastic portion to form a propping portion. The base portion and the elastic portion are located in the corresponding terminal receiving cavity. The contact portion projects out of the top surface. The propping portion is positioned in the corresponding positioning groove and restrained by the positioning portion, the buckling portion and the originated end to buffer an external lateral force affecting on the conductive terminal so as to share the impact of the external lateral force.

As described above, the battery connector can make the external lateral force uniformly distributed in the conductive terminal by means of the propping portion being restrained by the positioning portion, the buckling portion and the originated end so that the conductive terminal can bear a relative great external lateral force without a deformation of the conductive terminal this further prolongs the use life of the battery connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
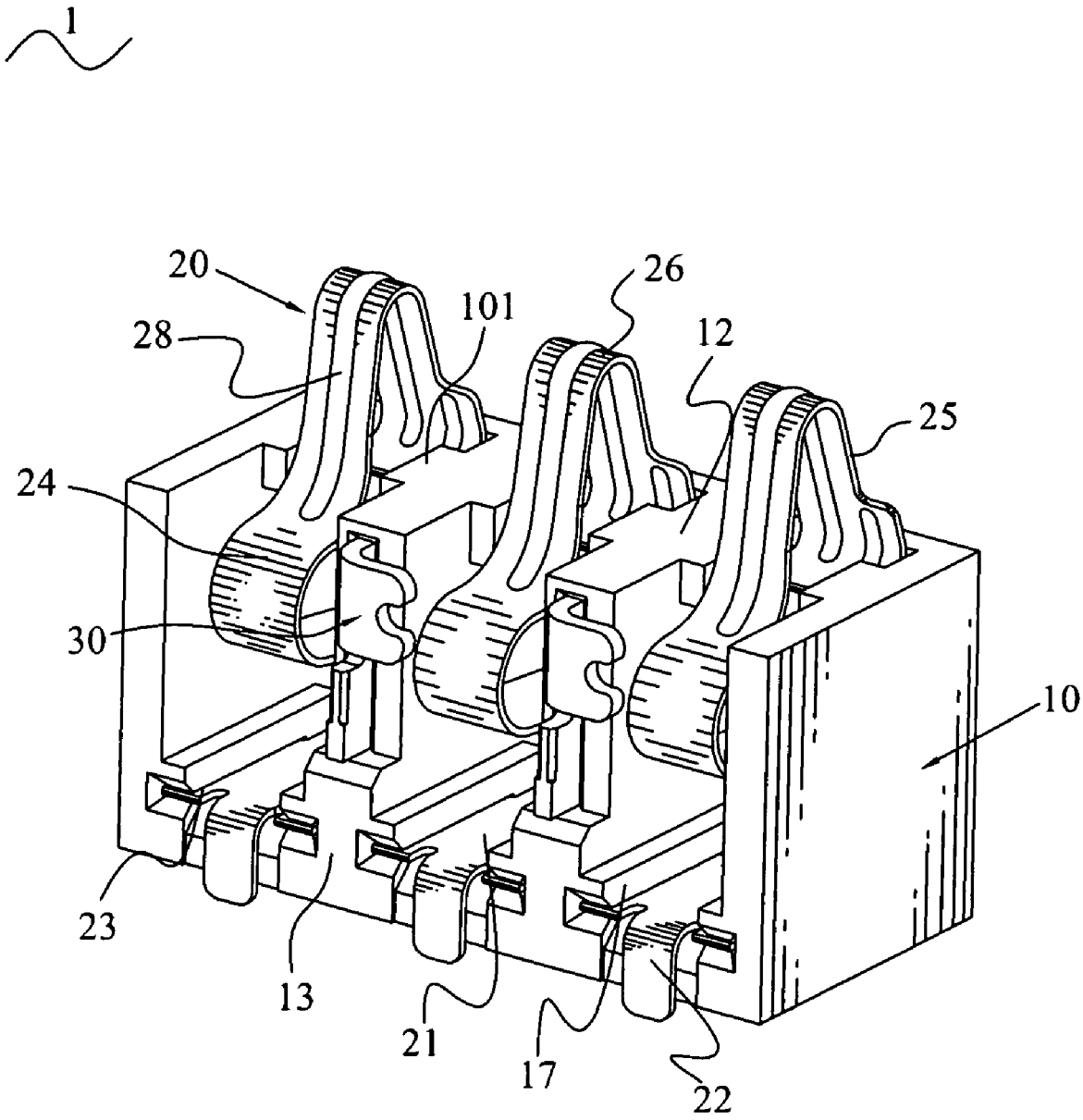
FIG. 1 is a perspective view of a battery connector according to a first embodiment of the present invention.
Figure 2:
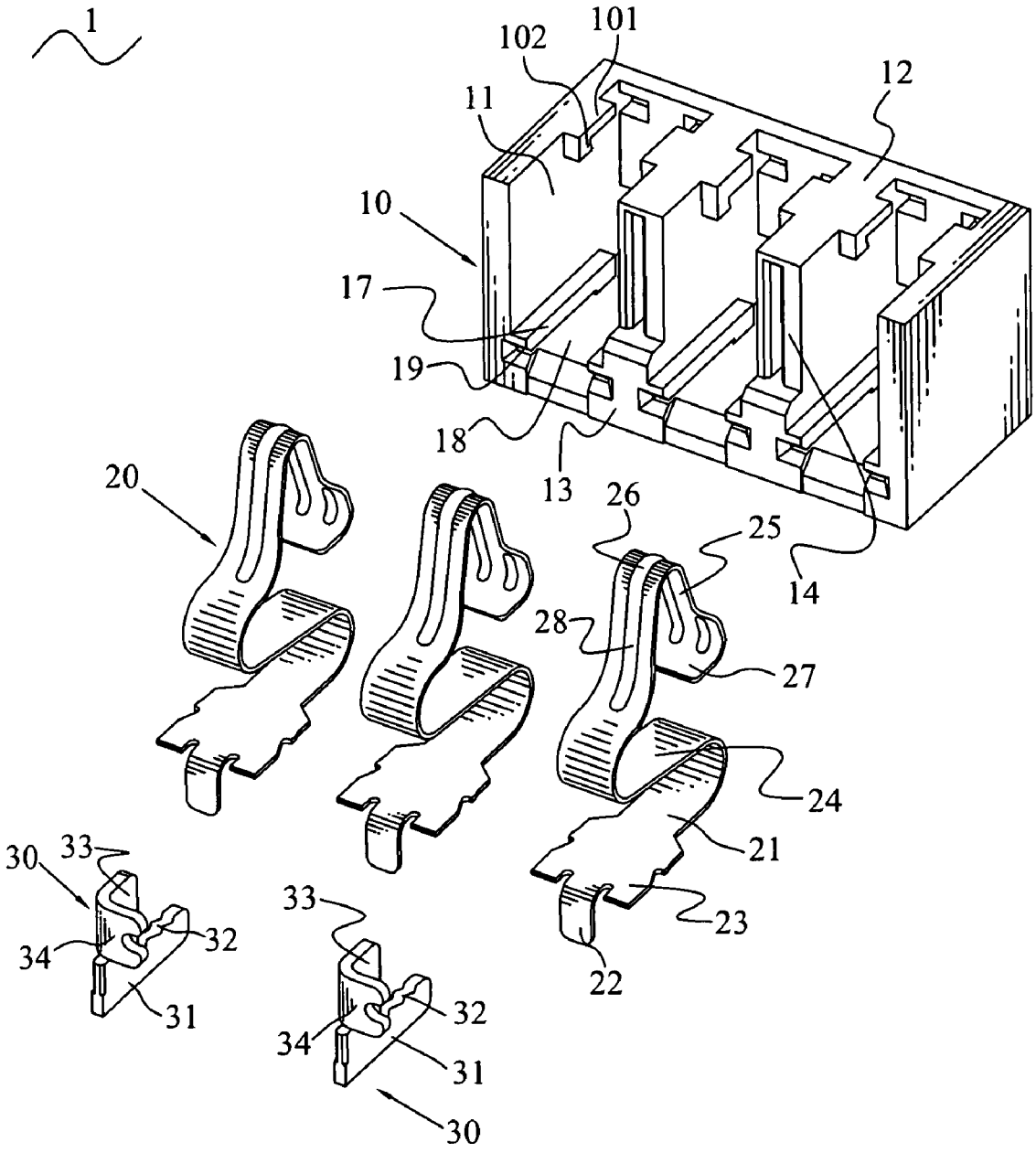
FIG. 2 is an exploded view of the battery connector of FIG. 1.
Figure 3:
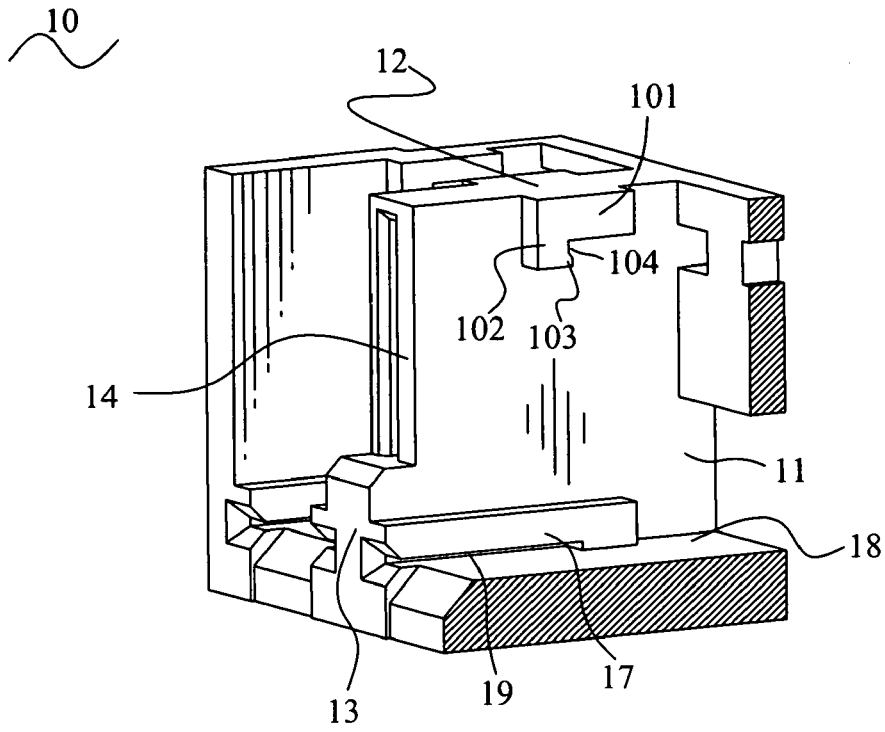
FIG. 3 is a sectional view of an insulating housing of the battery connector of FIG. 1.
Figure 4:
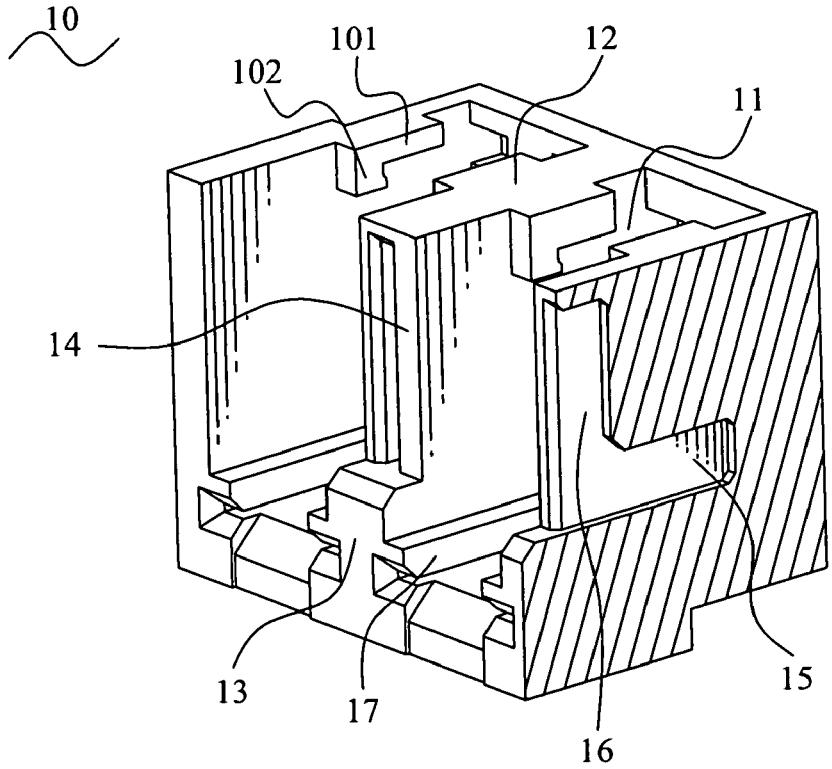
FIG. 4 is another sectional view of the insulating housing of the battery connector of FIG. 1.

With reference to FIG. 1 and FIG. 2, a battery connector 1 according to a first embodiment of the present invention is shown. The battery connector 1 includes an insulating housing 10, a plurality of conductive terminals 20 and a pair of fastening members 30 disposed in the insulating housing 10 respectively.

Referring to FIGS. 1-4, the insulating housing 10 is of substantially rectangular shape. The insulating housing 10 defines a plurality of rectangular terminal receiving cavities 11 arranged at regular intervals along a transverse direction thereof and each extending vertically and longitudinally to pass through a top surface 12 and a front surface 13 thereof. A plurality of separating walls 14 each is accordingly formed between two adjacent terminal receiving cavities 11 of the insulating housing 10. A front of the separating wall 14 defines a first inserting groove 15 extending longitudinally to pass through the front surface 13, and a second inserting groove 16 extending vertically to connect with a front end of the corresponding first inserting groove 15 and further pass through the front surface 13. Two opposite sides of the terminal receiving cavity 11 protrude face-to-face to form a pair of locating portions 17 each extending longitudinally to the front surface 13 at a lower portion of the terminal receiving cavity 11. A rear end of each of the locating portions 17 extends downward to connect with a bottom wall 18 of the terminal receiving cavity 11. A locating groove 19 is accordingly formed between the locating portion 17 and the bottom wall 18 and communicates with the terminal receiving cavity 11. The two opposite sides of the terminal receiving cavity 11 further protrude face-to-face to form a pair of positioning portions 101 spaced from each other and each extending longitudinally at a substantial middle of a top of the terminal receiving cavity 11. A front end of each of the positioning portions 101 extends downward to form a buckling portion 102 with an originated end 103 slightly extending rearward. A positioning groove 104 is formed between the positioning portion 101 and the buckling portion 102.

Figure 5:
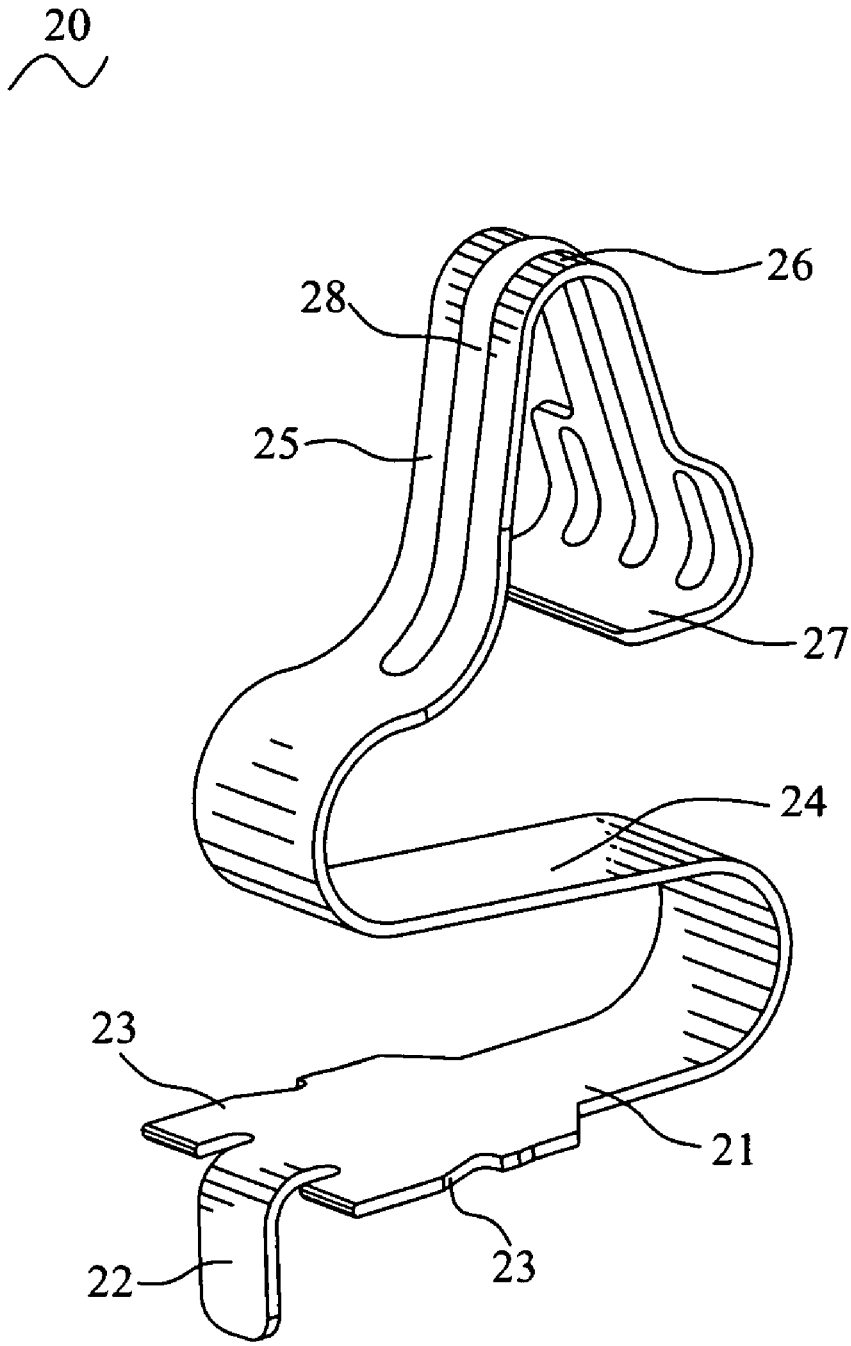
FIG. 5 is a perspective view of a conductive terminal of the battery connector of FIG. 1.
Figure 6:
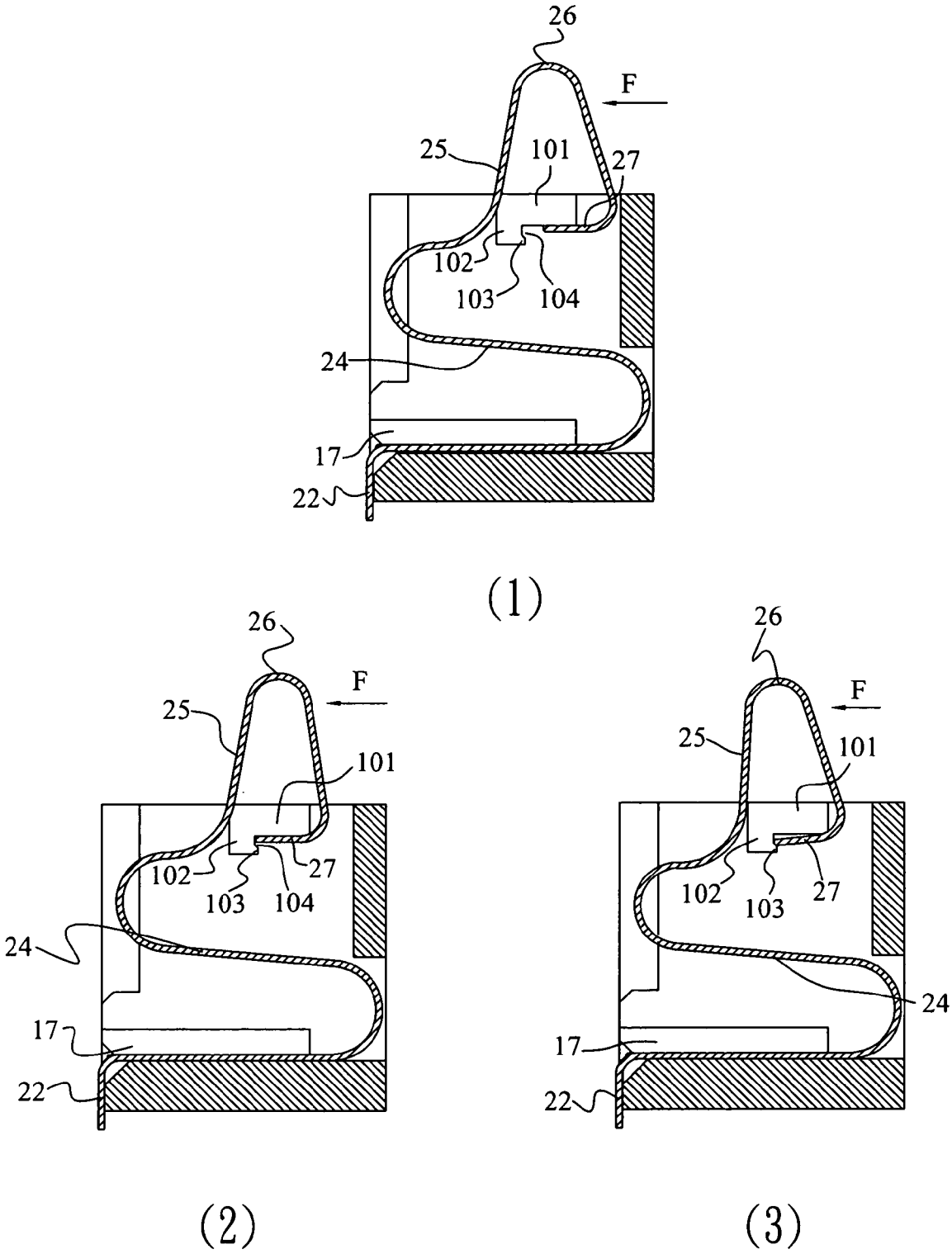
FIG. 6 is cross-sectional views of the battery connector of FIG. 1, showing a process of an external lateral force F being affected on the conductive terminal.

Referring to FIGS. 1-2 and FIG. 5, each of the conductive terminals 20 has a base portion 21 of rectangular plate shape. A front edge of the base portion 21 is perpendicularly bent to form a soldering portion 22. Two opposite side edges of the base portion 21 oppositely protrude outward to form a pair of holding portions 23. A rear edge of the base portion 21 extends towards an opposite direction to the soldering portion 22 to form an elastic portion 24 with a substantially serpentine shape. A free end of the elastic portion 24 further extends to form an inverted-V shape contact portion 25 with an opening facing the elastic portion 24. The bent portion of the contact portion 25 is defined as a contact point 26. A free end of the contact portion 25 is bent inward to form a propping portion 27 wider than the contact portion 25 in a transverse view. A holding rib 28 is formed to span a middle of an outer surface of the contact portion 25 and the propping portion 27 along an extending direction of the contact portion 25 and the propping portion 27.

Referring to FIGS. 1-2 again, each of the fastening members 30 has a rectangular base board 31 extending longitudinally and disposed vertically. A rear portion of a top edge of the base board 31 protrudes outward to form a plurality of fixing portions 32. A front portion of the top edge of the base board 31 extends upward to form an extending portion 33 with a rectangular board shape. A front edge of the extending portion 33 perpendicularly extends sideward to form a soldering tail 34.

Referring to FIGS. 1-6, in assembly, the elastic portion 24 and the base portion 21 of each of the conductive terminals 20 are disposed in the corresponding terminal receiving cavity 11 of the insulating housing 10. The two holding portions 23 are fixed in the corresponding locating grooves 19 of the insulating housing 10. The contact portion 25 stretches out of the top surface 12 of the insulating housing 10 for contacting a corresponding battery (not shown) by means of the contact point 26. Two opposite side ends of the propping portion 27 are positioned in the corresponding positioning grooves 104 and are restrained under the positioning portions 101 for further restraining the contact portion 25. The soldering portion 22 is exposed from the front surface 13 of the insulating housing 10 for being soldered with a printed circuit board (not shown). Each of the fastening members 30 is disposed in the insulating housing 10 with the base board 31 being inserted into the first inserting groove 15 and the extending portion 33 being inserted into the second inserting groove 16. The fixing portions 32 abut against an inner wall of the first inserting groove 15 to ensure a firm engagement between the fastening member 30 and the insulating housing 10. The soldering tail 34 is exposed out of the front surface 13 of the insulating housing 10 for being soldered with the printed circuit board. The soldering portion 22 of the conductive terminal 20 and the soldering tail 34 of the fastening member 30 are on the same plane so as to facilitate and strengthen the soldering between the battery connector 1 and the printed circuit board.

Referring to FIG. 6 again, when an external lateral force F affects on the contact portion 25 of the conductive terminal 20, the contact portion 25 is pressed along a direction of the external lateral force F till a free end of the propping portion 27 abuts against the buckling portion 102. At this time, if the external lateral force F continues affecting on the conductive terminal 20, then the free end of the propping portion 27 will be further against the originated end 103 of the buckling portion 102 for being restrained. So the propping portion 27 shares part of the external lateral force F and this makes the external lateral force F uniformly distributed in the conductive terminal 20 so as to make the contact portion 25 of the conductive terminal 20 bear a relative great external lateral force. The holding rib 28 is designed to strength the structure of the contact portion 25 and the propping portion 27 so that the conductive terminal 20 can further bear a relative great external lateral force.

Figure 7:
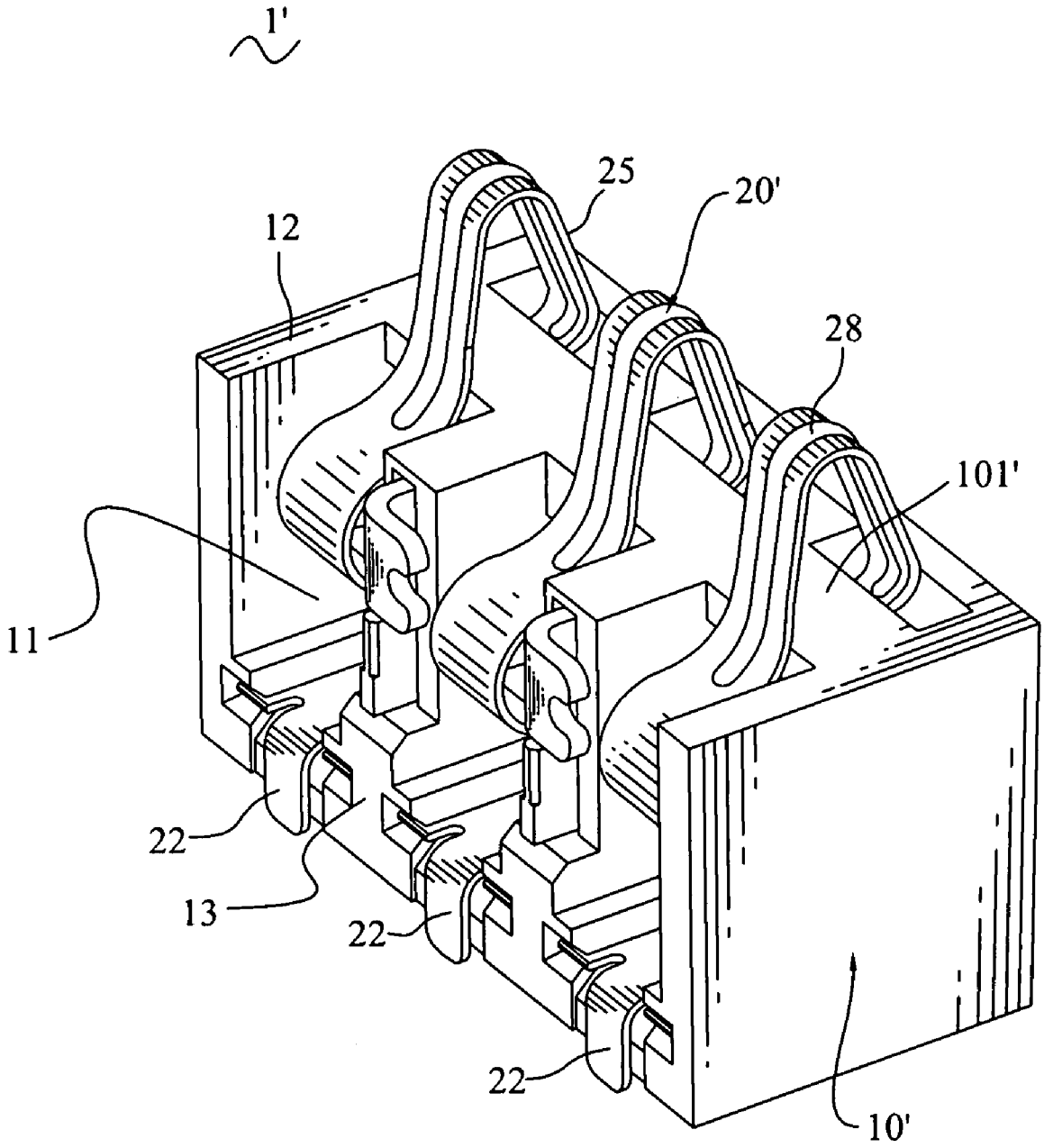
FIG. 7 is a perspective view of a battery connector according to a second embodiment of the present invention.
Figure 8:
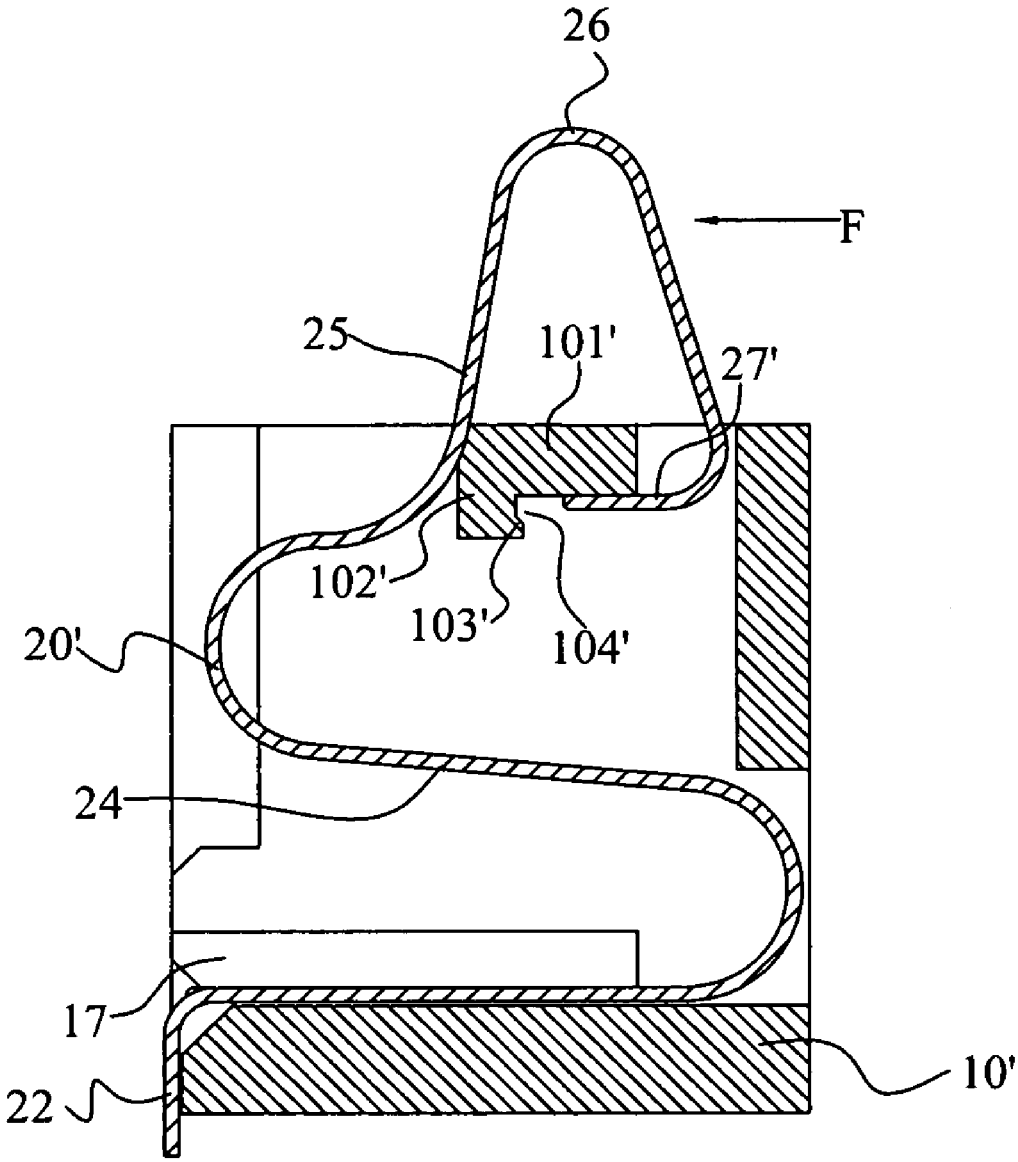
FIG. 8 is a cross-sectional view of the battery connector of FIG. 7, wherein an external lateral force F is affected on a conductive terminal.

Referring to FIGS. 7-8, a battery connector 1' according to a second embodiment of the present invention is shown. Comparing to the first embodiment, the difference is that an insulating housing 10' and conductive terminals 20' of the battery connector 1' are different from the insulating housing 10 and the conductive terminals 20 of the first embodiment, respectively. The difference therebetween will be described in detail hereinafter and the same construction between the battery connector 1' and the battery connector 1 will be omitted herefrom for simplicity and not be further described.

Referring to FIG. 2 and FIGS. 7-8 again, the difference between the insulating housing 10' and the insulating housing 10 is that a positioning portion 101' is perpendicularly connected with two opposite upper insides of each of the terminal receiving cavities 11 instead of the two corresponding positioning portions 101 in the first embodiment. A front end of the positioning portion 101' extends downward to form a buckling portion 102' with an originated end 103' slightly extending rearward. A positioning groove 104' is formed between the positioning portion 101' and the buckling portion 102'. The difference between the conductive terminal 20' and the conductive terminal 20 is that the conductive terminal 20' has a propping portion 27' which needn't be wider than the contact portion 25 in a transverse view. The propping portion 27' is positioned in the corresponding positioning groove 104' and restrained under the positioning portion 101' for further restraining the contact portion 25.

As described above, the battery connector 1, 1' can make the external lateral force F uniformly distributed in the conductive terminal 20, 20' by means of the propping portion 27, 27' being restrained by the positioning portion 101, 101', the buckling portion 102, 102' and the originated end 103, 103' so that the conductive terminal 20, 20' can bear a relative great external lateral force without a deformation of the conductive terminal 20, 20' this further prolongs the use life of the battery connector 1, 1'.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A battery connector, comprising:

an insulating housing defining a plurality of terminal receiving cavities each extending vertically and longitudinally to pass through a front surface and a top surface thereof, an upper portion of a side of each of the terminal receiving cavities protruding towards an opposite side of the terminal receiving cavity to form a positioning portion, one end of the positioning portion extending downward to form a buckling portion with an originated end extending under the positioning portion and being spaced therefrom, a positioning groove being formed between the positioning portion and the buckling portion; and a plurality of conductive terminals disposed in the insulating housing, each of the conductive terminals including a base portion, a substantially inverted-V shaped contact portion and an elastic portion elastically connecting the contact portion to the base portion, a free end of the contact portion being bent towards the elastic portion to form a propping portion, wherein the base portion and the elastic portion are located in the corresponding terminal receiving cavity, the contact portion projects out of the top surface, the propping portion is extended in the corresponding positioning groove from the other end of the positioning portion opposite to the buckling portion and is restrained under the positioning portion, with a free end thereof spaced from the buckling portion, the free end of the propping portion moves towards and then abuts against the buckling portion responsive to an external lateral force being applied on the contact portion reaching a certain value, and the free end of the propping portion then moves downwardly to abut against the originated end of the buckling portion responsive to the external lateral force continuing to increase.

2. The battery connector as claimed in claim 1, wherein the terminal receiving cavity has two positioning portions, two buckling portions, two originated ends, and two positioning grooves at corresponding portions of the two opposite sides thereof.

3. The battery connector as claimed in claim 2, wherein the propping portion of the conductive terminal is wider than the contact portion of the conductive terminal in a transverse view, two opposite side ends of the propping portion are positioned in the corresponding positioning grooves.

4. The battery connector as claimed in claim 1, wherein the positioning portion further extends to connect with the opposite side of the terminal receiving cavity, and the buckling portion and the originated end accordingly extend along with the positioning portion.

5. The battery connector as claimed in claim 1, wherein a holding rib is formed to span an outer surface of the contact portion and the propping portion along an extending direction of the contact portion and the propping portion for strengthening the contact portion and the propping portion.

6. The battery connector as claimed in claim 1, wherein the elastic portion is of substantially serpentine shape.

7. The battery connector as claimed in claim 1, wherein the two opposite sides of the terminal receiving cavity protrude face-to-face to form a pair of locating portions each extending longitudinally at a lower portion of the terminal receiving cavity, a locating groove is formed between the locating portion and a bottom wall of the terminal receiving cavity, two opposite side edges of the base portion of the conductive terminal oppositely protrude outward to form a pair of holding portions fixed in the corresponding locating grooves.

8. The battery connector as claimed in claim 7, wherein a rear end of the locating portion extends downward to connect with the bottom wall of the terminal receiving cavity for holding the holding portion firmly.

9. The battery connector as claimed in claim 1, further comprising a fastening member, the front surface of the insulating housing being concaved inward to form a L-shaped inserting groove from a lateral view between two adjacent terminal receiving cavities with a first inserting groove extending longitudinally and a second inserting groove extending vertically, the fastening member having a base board extending longitudinally to be inserted into the first inserting groove and an extending portion extending vertically to be connected with a front end of the base board and inserted into the second inserting groove, a front edge of the extending portion extending sideward to form a soldering tail exposed out of the front surface of the insulating housing.

10. The battery connector as claimed in claim 9, wherein a rear portion of a top edge of the base board protrudes outward to form a plurality of fixing portions abutting against the inside of the first inserting groove.

* * * * *